United States Patent [19]

Gauntt

[11] 4,009,511

[45] Mar. 1, 1977

[54] PROCESS FOR DRAWING POLYAMIDE MONOFILAMENTS

[75] Inventor: Sibbley Paul Gauntt, Bon Air, Va.

[73] Assignee: E. I. Du Pont de Nemours and Company, Wilmington, Del.

[22] Filed: Dec. 15, 1975

[21] Appl. No.: 641,135

Related U.S. Application Data

[63] Continuation of Ser. No. 480,759, June 19, 1974, abandoned.

[30] Foreign Application Priority Data

July 4, 1973 United Kingdom ..... 31809/73

[52] U.S. Cl. ..... 264/210 F; 264/178 F; 264/290 N

[51] Int. Cl.[2] ..... D01D 5/12

[58] Field of Search ..... 264/290 T, 210 F, 178 F

[56] References Cited

UNITED STATES PATENTS

| | | | |
|---|---|---|---|
| 3,650,884 | 3/1972 | Hausen | 428/395 |

FOREIGN PATENTS OR APPLICATIONS

| | | | |
|---|---|---|---|
| 45-26566 | 9/1970 | Japan | 264/290 N |
| 47-9,224 | 3/1972 | Japan | 264/290 T |
| 1,037,935 | 8/1966 | United Kingdom | 264/290 N |

*Primary Examiner*—Jay H. Woo
*Attorney, Agent, or Firm*—C. J. Shoaf

[57] ABSTRACT

Heavy denier, polyamide monofils are produced by the coupled steps of spinning, quenching, drawing and winding. Quenching involves passage of the filament through an air gap and a water bath. There are two stages of drawing. In the first stage, pressurized steam is used to deorient surface polymer and as a draw assist.

9 Claims, No Drawings

PROCESS FOR DRAWING POLYAMIDE MONOFILAMENTS

This is a continuation of application Ser. No. 480,759, filed June 19, 1974, now abandoned.

BACKGROUND OF THE INVENTION

This invention relates to the preparation of heavy denier, polyamide monofils having both high straight and high loop tensile properties.

Such filaments and their utility as reinforcements, e.g., in tires, have been described in U.S. Pat. No. 3,650,884 to Hansen. To insure cooling below the glass transition temperature and solidification before reaching the draw zone, the heavy denier monofil of Hansen is first advanced through an air gap and a water quenching bath. In the practice of those steps, conditions are carefully controlled but birefringence and transcrystalline orientation are nevertheless developed in a skin layer. That layer presents difficulties in the achievement of the desired extent of orientation in two coupled, radiantly heated, draw stages. The skin layer is deoriented and loop tenacity is improved by advancing the drawn filament through a zone of saturated or wet steam. Although operable, the existing process has shortcomings such as criticalities in the quenching steps, limitations on the extent of orientation in the draw zone and high contact time in the postdraw steaming step.

SUMMARY OF THE INVENTION

According to the present invention, the postdraw steaming step is eliminated and further improvements in transverse properties of the monofil are achieved in a process which includes coupled spinning, quenching, stretching and packaging steps. In a first draw stage, the quenched filament passes through a pressurized, surface-plasticizing, steam atmosphere and is orientation stretched to a draw ratio of at least 3.5×. In the second draw stage, the filament passes through a radiant heat zone and is orientation-stretched to a draw ratio of at least 1.3×. The total draw ratio in both stages is at least 5.5×.

DESCRIPTION OF THE PROCESS

Polyamides useful in this invention preferably have a relative viscosity (ratio of solution and solvent viscosities in a capillary viscometer at 25° C. using an 8.4% by weight solution of polymer dissolved in formic acid containing 10% by weight of water) of at least 50. The polyamides are the polymers of aliphatic diamines and dicarboxylic acids, or of amino acids, and copolymers thereof such as polyhexamethylene adipamide (6—6 nylon) and poly-ε-caproamide (6 nylon) and copolymers thereof. For 6—6 nylon, melt temperatures ranging from 270°–295° C. are operable.

The polyamide filament is melt spun through either a round, an obround or a rectangular (rounded corners), relatively large, spinneret orifice, subjected to attenuation in an air gap below the spinneret and quenched in water at a temperature less than 50° C. The air gap is from 20 to 40 inches (50.8–101.6 cm.) in length and distance traveled in the water bath is greater than 80 inches (203.2 cm.). Tension in the air gap and water bath is minimized in order to also minimize the development of positive birefringence and orientation in the filament surface before the filament is orientation stretched.

In the first of two stages of drawing, the filament is passed through a pressurized steam chamber which is defined by an elongated casing of square cross section that can be opened and closed for a stringup. At its ends, the casing has entrance and exit holes small enough to prevent excess steam loss but large enough to avoid damaging the filament. Typical ranges of first stage stretch processing conditions for 6—6 nylon involve steam pressures of 80–170 psig. (5.6–12.0 kg./cm.$^2$), preferably 100–130 psig. (7.0–9.1 kg./cm.$^2$), and steam quality may be selected from the range of from 40% wet to 120° F. of superheat. For process simplicity, superheated steam is preferred. For 6 nylon and copolymers of 6—6 nylon and 6 nylon, the steam pressure ranges are appropriately decreased approximately 30 psig. (2.1 kg./cm.$^2$).

The first stage stretch steam conditions are selected such that the heat assists stretching, which results in orientation of the core. Additionally, the steam substantially deorients the surface and prevents the development of molecular orientation or birefringence in the surface as the filament is stretched. To avoid oversteaming and consequent sacrifice in both straight and loop tensile properties after the second stretch, conditions are selected such that the depth of the steam penetration as evidenced by a sheath-core effect visible under optical microscopy is limited to a depth of less than about 15 microns. Insufficient steaming does not give a detectable sheath of deoriented polymer, resulting in good straight properties but low loop properties and high surface birefringence, following the second stretch.

The steam chamber for the first stage stretching need only be sufficiently long to achieve the desired residence time necessary for proper steaming. In a coupled, continuous process (i.e., spinning, quenching, stretching and wind-up combined), the chamber is advantageously shorter than that needed when steaming is done after stretching. For example, at a filament speed of about 85–145 yards/minute (77.7 to 132.6 meters/minute), the pressure chamber may be appropriately 1 to 4 feet (30.5 to 122 cm.) in length. Of course, the exact dimensions and exposure time are dependent upon the melting point of the polymer and such other factors as the steam temperature and pressure employed.

Preferably, the process employs a draw ratio of at least 3.7× in the first stage at a steam pressure of at least about 50 psig. (3.52 kg./cm.$^2$), with an exposure time of less than 1 second. Radiant heat is the preferred medium for assisting the second stage stretching of at least 1.3×. Total draw ratio should be high enough to achieve a refractive index, n//, greater than 1.57 for core polymer inside the surface layer.

Radiant heating in the second stage stretching involves the use of a heater at a temperature of 700° C. to 1300° C., preferably 900° to 1100° C., with an exposure time such that the filament surface temperature remains at least 10° C., preferably 30° C. below the melting point of the polymer. The preferred heater has a resistance bar enclosed in and anchored with respect to an interiorly insulated, cylindrical casing which radiates heat onto the filament. When 6—6 nylon is treated, an operable filament surface temperature range is 180°–250° C., preferably 200°–230° C. In the case of 6 nylon and copolymers of 6—6 and 6 nylon, the temperature ranges are appropriately adjusted for the melting points of each polymer. An operable range is 150°–220° C., preferably 170°–200° C., for 100% 6 nylon.

An important aspect of this invention is the discovery that, with proper steaming conditions in the first stage, the filament can be stretched at least 1.3× in the second stage without steam to achieve a further increase in straight tenacity while substantially retaining, or even increasing, loop tenacity. Be deorienting the surface polymer in the first stage, filament breaks in the second stage can be reduced. Improper steaming in the first stage stretch results in a significant loss of loop tenacity and more frequent breaks upon further stretching.

Filament breaks occur most frequently in the second stage of any two stage draw process. Thus, in the instant simplified process, what breaks there are generally occur after the filament has passed through the pressurized steam chamber. Consequently, there is no need to open the steam chamber to restring after a break, as in the postdraw steam chamber of Hansen.

Since surface polymer is deoriented in the first stage of stretching, quenching conditions in the air gap and water bath are less critical. More freedom in selecting the quenching conditions allows selection of other process variables, e.g., second stage draw requirements, more for uniformity and operability, resulting in improved product uniformity and process economy.

The product of the process has an optically visible surface layer having a thickness of less than about 15 microns, and which has reduced orientation and reduced density relative to a similarly stretched but unsteamed filament. The orientation or birefringence of the surface layer is greater than that produced by steaming after stretching as described by Hansen since, in this process, the filament is stretched at least 1.3× after steaming. This after-stretch under nonsurface-plasticizing conditions results in an intermediate level of orientation in the surface, greater than that from a poststeaming operation and less than that of the filament core, and in a diffuse rather than a sharp dye-penetration boundary between the core and surface. Consequently, there is a slightly reduced dye penetration, as compared to the level described by Hansen.

The high strength monofilaments of the invention have a denier greater than 1000, preferably 3000–5000, and are particularly useful as a substitute for twisted cords in tires. They should have straight and loop tenacities of at least 8 gpd. and 3 gpd., respectively, and preferably at least 8.5 gpd. and 3.5 gpd., respectively. For 6—6 nylon, it has been found that steaming conditions giving a refractive index, n//, of less than 1.567 (less than 1.547 prior to the second stretch) in a surface layer at least 3$\mu$ thick consistently permits achieving good loop tensile properties in the final product. Filaments which have been water quenched and drawn without steaming have a refractive index, n//, greater than 1.57.

Where reported herein, the refractive index for light polarized parallel to the filament axis, n//, is a measure of orientation within the monofil. A Leitz double beam interference microscope is used to determine whether the refractive index, n//, near the fiber surface is above or below a reference immersion medium. Determinations are made on wedge shaped longitudinal sections cut with a razor blade at the diameter of a round monofil or at the minor diameter of an obround filament spun from a rectangular orifice. These sections should be about 100$\mu$ thick and should gradually taper to zero thickness. The measurement consists of determining the thickness of the deoriented surface layer in media having the refractive indicates the range of 1.570 to 1.535, at a measurement temperature of 25.5° C. ± 1.5° C. Surface layer thickness measurements are made on interference micrographs at a magnification of 378–410×. These characterizations and other detailed information concerning the monofils and the improved process for their production are provided in the following illustrative examples.

EXAMPLE I

Polyhexamethylene adipamide having a relative viscosity of 70 is extruded at the rate of 27.2 pounds/hour (12.3 kg./hour) through a rectangular spinneret orifice having rounded corners 2.95 × 9.70 mm.), passed vertically downward through an air gap for 22 inches (55.9 cm.), quenched in water at 30° C. for a distance of 134.5 inches (342 cm.), passed to a feed roll having a surface speed of 126.3 ypm. (115.5 meters/minute) and then passed through a steam chamber 122 cm. in length containing wet steam with 94% quality at 110 psig. (7.73 kg./cm.$^2$) and at 173° C. (saturation temp.) to a first stage draw roll which orientation-stretches the filament 4.0×. The filament is under a relatively low tension of about 5000 grams between the rolls, From the first stage draw rolls, the filament makes 3 passes through a 122 cm. radiant heating zone at 1050° C. to second stage draw rolls which orientation-stretch the steamed and drawn filament an additional 1.43× for a total draw ratio of 5.70×. The filament is wound into a package. The filament has a denier of 3000 and a substantially flat, ribbon-shaped cross section with a thickness of 0.338 mm. and a width of 0.922 mm. The filament has a straight tenacity of 8.6 grams/denier and a loop tenacity of 4.1 grams/denier with 13.3% and 8.9% elongations, respectively, measured as described in U.S. Pat. No. 3,650,884. Optical examination of the filament cross section under a microscope shows a visibly apparent surface layer about 3.9 microns thick as a result of the steam treatment. The filament surface has a refractive index, n//, of about 1.565. This surface layer has a reduced density compared to the filament core.

Prior to the second stretch, the filament surface was found to have substantially zero birefringence. After the second stage, it was found to have a surface birefringence of about 0.046. Prior to the second stretch, the filament had a straight tenacity of 4.5 gpd. and a loop tenacity of 4.7 gpd. with 51.7% and 56.6% elongations, respectively.

Another filament was prepared in essentially an identical manner except for the use of superheated steam at 110 psig. (7.73 kg./cm.$^2$) and 235° C. in the first stage stretch. This produced a filament having a straight tenacity of 9.2 grams/denier, a loop tenacity of 5.0 grams/denier, and elongations of 17.1% and 8.6%, respectively. Prior to the second stretch, the filament had a straight tenacity of 4.7 gpd. and a loop tenacity of 4.7 gpd. with 51.4% and 57.8% elongations, respectively.

EXAMPLE II

Polyhexamethylene adipamide having a relative viscosity of 70 and a melt temperature of 284° C., is extruded at the rate of 31.4 lb./hr. (14.24 kg./hr.) through a rectangular spinneret orifice having rounded corners (2.95 mm. × 9.70 mm.), passed vertically downward through an air gap for 25 inches (63.5 cm.) and quenched in water at 15° C. for a distance of 134.5 inches (342 cm.). From the water bath, the monofil is passed to a feed roll having a surface speed of 145.6 ypm. (133.1 meters/minute), then passed through a steam chamber 2½ ft. (76.2 cm.) in length containing dry steam superheated to ~100° F. (55° C.) above saturation temperature at 151 psig. (10.62 kg./cm.²), i.e., at ~470° F. (243° C.), to a first stage draw roll which orientation-stretches the filament 3.77×. The filament is under a tension of 3.5 kg. in the steam chamber; filament surface temperature is 35° C. entering and 125° C. exiting the steam chamber. From the first stage draw rolls, the filament makes 3 passes through a 122 cm. radiant heater at 1010° C. to second stage draw rolls which stretch the steamed and drawn filament an additional 1.51× for a total draw ratio of 5.70× under a tension of ~7.9 kg.; the filament surface temperature is ~215° C. The filament is relaxed 2% and wound onto a package. The filament has a denier of 3000 and a substantially flat, ribbonshaped cross section with a thickness of 0.338 mm. and width of 0.923 mm. The filament has a straight tenacity of 8.6 gpd. and a loop tenacity of 4.89 gpd. with 14.0% and 8.0% elongations, respectively, measured as described in U.S. Pat. No. 3,650,884. Prior to the second stretch, the filament had average straight and loop tenacities of 4.7 and 4.05 gpd., and elongations of 54.5 and 42.2%, respectively. Optical examination of the filament cross section under a microscope shows a visibly apparent surface layer about 6.1$\mu$ thick in the final product, as compared to a thickness of 10.0$\mu$ thick after steam treatment but before final drawing. The filament surface layer has a refractive index measured parallel to the filament axis, n//, of less than 1.567, and less than 1.547 prior to the second stretch. This surface layer has reduced density compared to the filament core.

In an otherwise similar test, conditions are the same except that the polymer has a melt temperature of 289° C., the air gap is 35 inches (88.9 cm.), the quench water is at 35° C. and the first stage draw ratio is 4.23×. The filament is under a tension of ~5.6 kg. in the steamer; filament surface temperature is 42° C. entering and 136° C. exiting the steamer. Second stage draw ratio is 1.35× for a total draw ratio 5.70×. Second stage tension is ~8.6 kg. and filament surface temperature is ~200° C. The filament has a straight tenacity of 9.2 gpd. and a loop tenacity 5.0 gpd., with 15.8% and 9.0% elongations, respectively. Prior to the second stretch, the filament had average straight and loop tenacities of 5.3 and 4.7 gpd., and elongations of 40.8 and 30.7%, respectively. The visibly-apparent surface layer has a thickness of about 7.5$\mu$ in the final product compared to a thickness of 8.3$\mu$ before the second stage. Refractive index, n//, is less than 1.567, and less than 1.547 prior to the second stretch.

It is apparent that the exemplified process may be modified in many ways without departing from the spirit of the invention which is accordingly, intended to be limited only by the scope of the appended claims.

Having thus described the invention, what is claimed as new and desired to be secured by letters patent is:

1. In a process including the coupled steps of spinning, quenching and drawing a heavy denier, aliphatic polyamide monofilament in first and second draw stages to a total draw ratio of at least 5.5×, the improvement comprising:

water-quenching the monofilament, advancing the quenched monofilament, in said first draw stage through a pressurized, surface-plasticizing, steam atmosphere wherein it is orientation-stretched at a ratio of at least 3.5×, and then advancing the monofilament, in said second draw stage through a zone heated with a radiant heater at a temperature of 700° C.–1300° C. wherein it is orientation-stretched at a ratio of at least 1.3×.

2. The process of claim 1, wherein the temperature of the quenching water is less than 50° C. and steam pressure in said first stage is in the range of 50–170 psig.

3. The process of claim 1 wherein the steam penetrates the monofilament to a depth of less than about 15 microns.

4. The process of claim 1 wherein the steam in the first draw stage is superheated steam.

5. The process of claim 1 wherein the monofilament is drawn at a draw ratio of at least 3.7× and at a steam pressure of at least 50 psig with an exposure time of less than 1 second in the first draw stage.

6. The process of claim 5 wherein the monofilament is drawn at a total draw ratio such that the polymer in the core of the monofilament has a refractive index greater than 1.57.

7. The process of claim 1 wherein 6—6 nylon is drawn at a steam pressure of 80–170 psig and steam quality of 40% wet to 120° F. of superheat in the first draw stage.

8. The process of claim 7 wherein the polyamide is 6—6 nylon and the surface temperature of the monofilament in the second draw stage is 180°–250° C.

9. The process of claim 7 wherein the polyamide is 6 nylon and the surface temperature of the monofilament in the second draw stage is 150°–220° C.

* * * * *